US005146894A

United States Patent [19]

Rembold et al.

[11] Patent Number: 5,146,894

[45] Date of Patent: Sep. 15, 1992

[54] RESERVOIR-TYPE FUEL INJECTION SYSTEM

[75] Inventors: Helmut Rembold, Stuttgart; Ernst Linder, Muehlacker, both of Fed. Rep. of Germany

[73] Assignee: Robert Bosch GmbH, Stuttgart, Fed. Rep. of Germany

[21] Appl. No.: 752,534

[22] PCT Filed: Feb. 17, 1990

[86] PCT No.: PCT/DE90/00108

§ 371 Date: Sep. 6, 1991

§ 102(e) Date: Sep. 6, 1991

[87] PCT Pub. No.: WO90/10789

PCT Pub. Date: Sep. 20, 1990

[30] Foreign Application Priority Data

Mar. 10, 1989 [DE] Fed. Rep. of Germany ..... 3907766

[51] Int. Cl.[5] ..... F02M 45/02

[52] U.S. Cl. ..... 123/447; 123/300

[58] Field of Search ..... 123/447, 450, 299, 300, 123/467, 446; 417/462

[56] References Cited

U.S. PATENT DOCUMENTS

| | | | |
|---|---|---|---|
| 3,438,359 | 4/1969 | Thoma | 123/300 |
| 3,568,646 | 3/1971 | Wehde | 123/447 |
| 3,592,177 | 7/1971 | Wehde | 123/456 |
| 3,789,818 | 2/1974 | Asbery | 123/447 |
| 4,167,168 | 9/1979 | Yamamoto | 123/300 |
| 4,289,098 | 9/1981 | Norberg | 123/299 |
| 4,481,921 | 11/1984 | Tsukahara | 123/300 |
| 4,590,903 | 5/1986 | Hofmann | 123/300 |
| 4,633,836 | 1/1987 | Faupel | 123/447 |
| 4,951,626 | 8/1990 | Haag | 123/300 |
| 5,044,903 | 9/1991 | Rembold | 123/300 |

FOREIGN PATENT DOCUMENTS

| | | |
|---|---|---|
| 3330774 | 3/1985 | Fed. Rep. of Germany . |
| 57-212362 | 12/1982 | Japan . |
| 8101173 | 4/1981 | PCT Int'l Appl. . |

*Primary Examiner*—Carl S. Miller

*Attorney, Agent, or Firm*—Edwin E. Greigg; Ronald E. Greigg

[57] ABSTRACT

In a reservoir-type fuel injection system, fuel can be supplied under pressure by a charge pump to two separate pressure reservoirs and the pressure reservoirs communicates via separate valve assemblies with injection nozzles via lines. By means of the separate reservoirs, overlapping of pre-injection and main injection events in different cylinders can be avoided.

20 Claims, 1 Drawing Sheet

RESERVOIR-TYPE FUEL INJECTION SYSTEM

Figure 1:
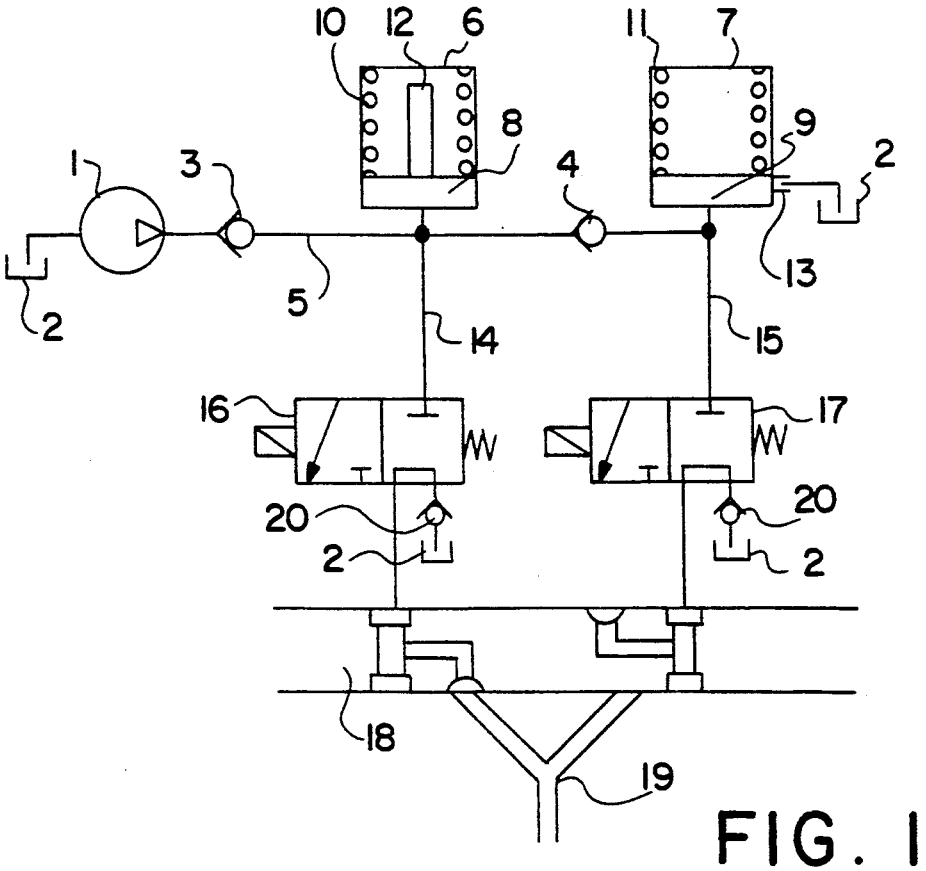

The invention is based on a reservoir-type fuel injection system as defined hereinafter.

In reservoir-type fuel injection systems of this kind, fuel is placed in a pressure reservoir under pressure by a charge pump that pumps continuously; a check valve is provided between the charge pump and the pressure reservoir to prevent fuel from being forced back into the pump under pressure in the intake stroke of the pump. Consequently, reservoir-type fuel injection systems require control devices that monitor the quantity and timing of the further supply of the fuel under pressure to the injection nozzle; rotating distributor shafts and/or valve assemblies, particularly magnet valves are used for this purpose, for example. In typical reservoir-type fuel injection systems of the type referred to the outset above, there is no separate regulation of the charge pump, and provision is made merely that the charge pump pump an adequate quantity of fuel to the reservoir, which makes it impossible to completely evacuate the reservoir, particularly at high rpm.

In reservoir-type fuel injection systems, injection can be done directly into the engine combustion chamber during both the intake stroke and the compression stroke of an Otto engine. To improve emissions, it has become known to divide the injection quantity into portions, in particular a pre-injection quantity and a main injection quantity. Particularly in multi-cylinder engines, this can result in an overlap in drawing fuel from such a reservoir, and overlapping of pre-injection and main injection events in various cylinders can occur. Such overlapping of injection events can consequently lead to problems in exact metering of the injection quantities, and it is not readily possible to insure defined injection quantities for various injection events.

From Japanese Patent Document A 57/212362, a reservoir-type fuel injection system is known. In the known system, however, the two reservoirs, one of which serves to store the fuel injection quantity for the pre-injection and the other to store the fuel injection quantity for a main injection, communicate parallel to one another with the pump work chamber of the high-pressure pump, each via an interposed check valve. This arrangement has the disadvantage that upon filling of the reservoir, the quantity of fuel pumped per pump piston stroke by the high-pressure pump, which is embodied as a piston pump, is divided into the two reservoirs, but there is no assurance as to which quantity of fuel pumped by the high-pressure pump reaches which reservoir. Filling of the various reservoirs depends on various parameters, such as the flow resistance, the opening pressure of the check valves, and the reservoir spring. The result, especially if, as is typical, the pre-injection quantity is kept very small, is a relatively major error in the pre-injection metering quantity.

The embodiment of the reservoir-type fuel injection system according to the invention, contrarily, has the advantage that by the stroke limitation of the movable wall such as a piston of the first reservoir, a defined fuel quantity can be pre-stored, and can in particular advantageously be used for a pre-injection. For this kind of injection, the reservoir piston is always located in a defined outset position before the metering of the applicable fuel injection quantity from this reservoir is controlled. The stroke limitation assures that the following reservoir will be reliably filled, and its movable wall will be moved up to a position defined by opening the overflow opening. At the instant of metering a defined outset position of the movable wall thus exists, which increases the accuracy of injection and fuel metering.

The embodiment of the reservoir-type fuel injection system according to the invention further has the advantage that overlapping of injection events, particularly when the injection event is divided into a pre-injection and a main injection event, can be avoided, and that it can simultaneously be assured that for both the pre-injection and the main injection, not only the predefined quantity but also a predefined pressure can be adhered to.

By means of the provisions recited herein, advantageous further developments of and improvements to the reservoir-type fuel injection system disclosed are possible.

A particularly simple structural embodiment can be attained by providing that the separate reservoirs are coaxially arranged and have one common compression spring for both reservoir pistons. In this kind of embodiment, it is also readily possible to make different pressure levels available for the pre-injection and main injection; for this purpose, the embodiment can be simply such that the pistons of the reservoirs have different cross-sectional areas.

Particularly in conjunction with multi-cylinder engines and a correspondingly high number of switching events in the valves for dividing the injection into the pre-injection and main injection, it is especially advantageous for the embodiment to be such that in addition to the magnet valves, a distributor valve, in particular a rotating shaft with control bores or grooves, is incorporated into the line to the injection nozzles; this kind of embodiment is known per se in conjunction with conventional reservoir-type fuel injection systems.

The invention will be described below in further detail in terms of exemplary embodiments schematically shown in the drawing. Shown in the drawing are FIG. 1, a schematic illustration of a first embodiment of a reservoir-type fuel injection system according to the invention, and FIG. 2, a modified embodiment of a reservoir for use in a reservoir-type fuel injection system according to the invention.

In the reservoir-type fuel injection system of FIG. 1, a charge pump 1 pumps fuel from a tank 2 via one way check valves 3, 4 through a common fuel pressure line 5 into two pressure reservoirs 6 and 7; the movable walls or pistons 8, 9 of the reservoirs are each acted upon by springs 10 and 11. The reservoir 6, used for a pre-injection, has a stop 12 that limits the reservoir volume of the first reservoir 6. The reservoir 7 used for a main injection has an overflow opening 13, so that if the maximum fill volume or maximum fill pressure of the reservoir 7 is exceeded, the overflow opening 13 is opened, and fuel can flow out under pressure into the tank or return line, again schematically represented by the numeral 2.

The two pressure reservoirs 6 and 7 communicate with injection nozzles, not shown in detail via pressure lines 14 and 15 and magnet valves 16 and 17 disposed in those lines and via a distributor formed as a rotationally driven rotary slide valve, 18 incorporated into the pressure lines downstream of the magnet valves 16, 17, depending on the rotary position of the distributor valve 18; a feed line to an injection nozzle of this kind is indicated in FIG. 1 by reference numeral 19. In the position of magnet valves 16 and 17 shown in FIG. 1, no drawing of fuel from the pressure reservoirs takes place. Upon a switchover of the magnet valve 16, in the rotary position of the distributor valve 18 shown, a pre-injection in a nozzle can be performed via the line 19. As a result, after a corresponding rotation of the distributor valve 18, which is generally coupled to the camshaft, a main injection can also be performed in the same injection nozzle, given appropriate switching of the magnet valve 17 in the pressure line 15.

As a result of the provision of two separate pressure reservoirs 6 and 7 for a pre-injection and a main injection, a pre-injection and a main injection can also be performed simultaneously in two different cylinders, without thereby causing mutual influence of the various injection events on one another. Since the pre-injection quantity generally amounts to 10 to 20% of the main injection quantity, the embodiment shown in FIG. 1 assures that the piston 8 of the pressure reservoir 6 is always located on the defined stop. Mutual influence of the two pressure reservoirs 6 and 7 on one another is prevented by the check valve 4. By suitable dimensioning of the piston cross sections and compression springs 10 and 11, different pressure levels can also be maintained in the two pressure reservoirs.

It is assumed that the charge pump 1 furnishes a largely pulsation-free feed flow, and that an adequate quantity of fuel is pumped into each of the reservoirs 6 and 7, so that even at maximum rpm, evacuation of the reservoirs 6 and 7 is prevented in any case. Besides the overflow opening 13 for limiting the maximum reservoir volume, a regulating device, not shown in further detail, for a load-depending pumping by the charge pump may be provided.

In the position of the magnet valves 16 and 17 shown in FIG. 1, a relief of the pressure line 19 to the return line or to the tank 2 takes place via check valves 20.

Figure 2:
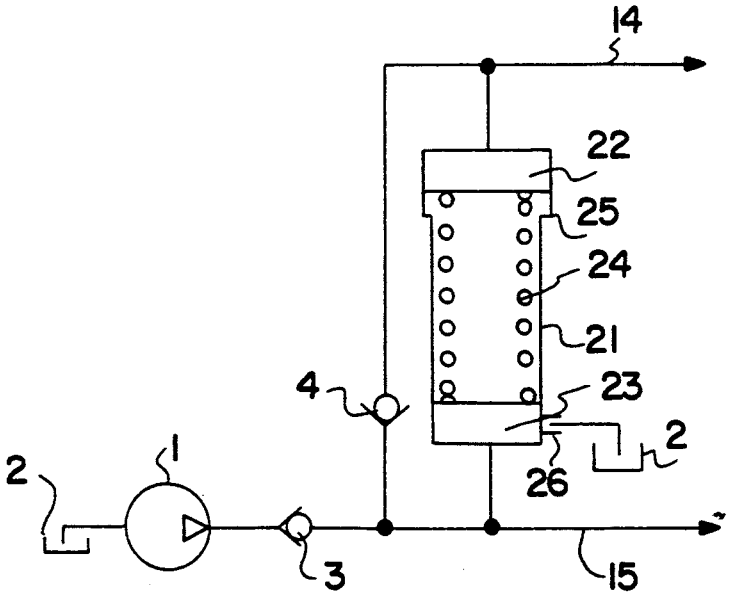

In the embodiment shown in FIG. 2, the charge pump 1 pumps via check valves 3 and 4 into a reservoir 21, in which two reservoir pistons 22 and 23 are acted upon by a common compression spring 24. Thus both reservoir pistons for the two separate pressure reservoirs for the pre-injection and the main injection are disposed coaxially to one another in a common housing; the reservoir piston 22 limits the reservoir space for the pre-injection and communicates with the pressure line 14, while the reservoir piston 23 limits the reservoir space for the main injection and communicates with the pressure line 15. The reservoir piston 22 can again be moved toward a stop 25, while the reservoir piston 23 cooperates with an overflow opening 26, which if the maximum reservoir volume is exceeded opens an outflow cross section in the tank 2. As in the embodiment of FIG. 1, magnet valves 16 and 17, respectively and/or a distributor valve 18 to pressure lines 19 to injection nozzles are again disposed in the lines 14 and 15. By dimensioning the cross section and the reservoir pistons 22 and 23 differently, it is assured that the pre-injection piston when acted upon with pressurized fuel will rest on the stop 25 whenever no injection is being performed. Any possible influence on the injection events via the coupling of the reservoir pistons 22 and 23 via the common compression spring 24 can be ignored, given suitable spring dimensioning with a low spring constant.

We claim:

1. A reservoir-type fuel injection system having a high-pressure pump, which can be made to communicate with a first reservoir (6) and a second reservoir (7), each reservoir is provided with a wall (8, 9; 22, 23) that is movable relative to a restoring force (10, 11; 24) in each said reservoir, wherein the first reservoir (6) can be decoupled from the high-pressure pump (1) by a first one-way check valve (3) and the second reservoir (7) can be decoupled from this said high-pressure pump by a second one-way check valve (4), and wherein the first reservoir and the second reservoir can be made to communicate with a common injection nozzle via a first line (14) and a first, controlled valve (16) that communicates directly with said first reservoir and a second line (15) and a controlled valve (17) that communicates with said second reservoir, said second reservoir (7; 21, 23) is also connected to an outlet side of the first reservoir (6; 21, 22) via the second check valve (4); and the first reservoir (6; 21, 22) has a stroke limiting stop (12; 25) for said movable wall (8; 22) therein and said second reservoir (7; 21, 23) has an overflow opening (13; 26) controlled by said movable wall (9; 23) therein.

2. A reservoir-type fuel injection system as defined by claim 1, in which said first and second reservoirs (21) are coaxially disposed and have one common compression spring (24) for both reservoirs (22, 23).

3. A reservoir-type fuel injection system as defined by claim 1, in which said movable walls (8, 9, 22, 23) of said first and second reservoirs (6, 7, 21) have different cross-sectional areas.

4. A reservoir-type fuel injection system as defined by claim 2, in which said movable walls (8, 9, 22, 23) of said first and second reservoirs (6, 7, 21) have different cross-sectional areas.

5. A reservoir-type fuel injection system as defined by claim 1, in which the controlled valves (16, 17) are magnet valves, the outlets of said valves can be made to communicate with the injection nozzles via a distributor valve 18 in particular via a rotationally driven rotary slide valve.

6. A reservoir-type fuel injection system as defined by claim 2, in which the controlled valves (16, 17) are magnet valves, the outlets of said valves can be made to communicate with the injection nozzles via a distributor valve 18 in particular via a rotationally driven rotary slide valve.

7. A reservoir-type fuel injection system as defined by claim 3, in which the controlled valves (16, 17) are magnet valves, the outlets of said valves can be made to communicate with the injection nozzles via a distributor valve 18 in particular via a rotationally driven rotary slide valve.

8. A reservoir-type fuel injection system as defined by claim 4, in which the controlled valves (16, 17) are magnet valves, the outlets of said valves can be made to communicate with the injection nozzles via a distributor valve 18 in particular via a rotationally driven rotary slide valve.

9. A reservoir-type fuel injection system as defined by claim 1, in which the movable wall (8, 9, 22, 23) of the first and second reservoirs (6, 7, 21) have different cross-sectional areas.

10. A reservoir-type fuel injection system as defined by claim 2, in which the movable wall (8, 9, 22, 23) of the first and second reservoirs (6, 7, 21) have different cross-sectional areas.

11. A reservoir-type fuel injection system as defined by claim 3, in which the movable wall (8, 9, 22, 23) of the first and second reservoirs (6, 7, 21) have different cross-sectional areas.

12. A reservoir-type fuel injection system as defined by claim 4, in which the movable wall (8, 9, 22, 23) of the first and second reservoirs (6, 7, 21) have different cross-sectional areas.

13. A reservoir-type fuel injection system as defined by claim 1, which includes a rotating shaft distributor valve (18) with control bores incorporated into the line (14, 15) to the injection nozzles.

14. A reservoir-type fuel injection system as defined by claim 2, which includes a rotating shaft distributor valve (18) with control bores incorporated into the line (14, 15) to the injection nozzles.

15. A reservoir-type fuel injection system as defined by claim 3, which includes a rotating shaft distributor valve (18) with control bores incorporated into the line (14, 15) to the injection nozzles.

16. A reservoir-type fuel injection system as defined by claim 4, which includes a rotating shaft distributor valve (18) with control bores incorporated into the line (14, 15) to the injection nozzles.

17. A reservoir-type fuel injection system as defined by claim 9, which includes a rotating shaft distributor valve (18) with control bores incorporated into the line (14, 15) to the injection nozzles.

18. A reservoir-type fuel injection system as defined by claim 10, which includes a rotating shaft distributor valve (18) with control bores incorporated into the line (14, 15) to the injection nozzles.

19. A reservoir-type fuel injection system as defined by claim 11, which includes a rotating shaft distributor valve (18) with control bores incorporated into the line (14, 15) to the injection nozzles.

20. A reservoir-type fuel injection system as defined by claim 12, which includes a rotating shaft distributor valve (18) with control bores incorporated into the line (14, 15) to the injection nozzles.

* * * * *